US006310442B1

(12) United States Patent
Vollkommer et al.

(10) Patent No.: US 6,310,442 B1
(45) Date of Patent: Oct. 30, 2001

(54) DISCHARGE LAMP WITH DIELECTRICALLY IMPEDED ELECTRODES

(75) Inventors: Frank Vollkommer, Buchendorf; Lothar Hitzschke, München, both of (DE)

(73) Assignee: Patent-Treuhand-Gesellschaft für Elektrische Glühlampen mbH, Munich (DE)

( * ) Notice: Subject to any disclaimer, the term of this patent is extended or adjusted under 35 U.S.C. 154(b) by 0 days.

(21) Appl. No.: 09/445,696

(22) PCT Filed: Feb. 18, 1999

(86) PCT No.: PCT/DE99/00450

§ 371 Date: Dec. 13, 1999

§ 102(e) Date: Dec. 13, 1999

(87) PCT Pub. No.: WO99/54917

PCT Pub. Date: Oct. 28, 1999

(30) Foreign Application Priority Data

Apr. 20, 1998 (DE) ..... 198 17 475

(51) Int. Cl.[7] ..... H01J 11/00

(52) U.S. Cl. ..... 315/246; 313/620; 313/607; 315/260

(58) Field of Search ..... 315/94, 202, 246, 315/248, 233, 260, 261, 268, 326, 334; 313/234, 493, 594, 607, 620

(56) References Cited

U.S. PATENT DOCUMENTS

| | | | | |
|---|---|---|---|---|
| 4,792,732 | * | 12/1988 | O'Loughlin | 313/607 |
| 5,117,160 | | 5/1992 | Konda et al. | 315/326 |
| 5,514,934 | * | 5/1996 | Matsumoto et al. | 313/234 |
| 5,604,410 | | 2/1997 | Vollkommer et al. | 315/246 |
| 5,889,366 | * | 3/1999 | Yokokawa et al. | 313/607 |

FOREIGN PATENT DOCUMENTS

| | | |
|---|---|---|
| 0766286 | 4/1997 | (EP) . |
| WO 94/23442 | 10/1994 | (WO) . |

OTHER PUBLICATIONS

Patent Abstracts of Japan, vol. 017, No. 698 (E–1481), Dec. 20, 1993, of JP 05 242870 (Mitsubishi Electric Corp.), Sep. 21, 1993.

Patent Abstracts of Japan, vol. 097, No. 004, Apr. 30, 1997, of JP 08 329903 (Ushio Inc.), Dec. 13, 1996.

* cited by examiner

*Primary Examiner*—Don Wong
*Assistant Examiner*—Wilson Lee
(74) *Attorney, Agent, or Firm*—Frishauf, Holtz, Goodman, Langer & Chick, P.C.

(57) ABSTRACT

A discharge lamp (1) including a tubular discharge vessel (2), filled with inert gas and, optionally, a fluorescent layer, having at least three elongated electrodes (3, 4, 5) arranged parallel to the longitudinal axis of the tubular discharge vessel (2). The electrodes are arranged in such a manner that the relationship $$\frac{s}{a} \geq 0.1$$

is satisfied, wherein s is the maximum spacing between an imaginary connecting line of an electrode pair and the most closely neighboring point on the wall of the tubular discharge vessel, and a is the mutual spacing between the electrodes of such electrode pair. A higher luminous density is achieved in this way. The lamp is particularly advantageous for a pulsed, dielectrically impeded discharge.

20 Claims, 5 Drawing Sheets

DISCHARGE LAMP WITH DIELECTRICALLY IMPEDED ELECTRODES

BACKGROUND OF THE INVENTION

1. Field of the Invention

The present invention relates to a discharge lamp and an illuminating system containing such discharge lamp.

The invention relates to a discharge lamp, in particular also to a fluorescent lamp, in which all electrodes are arranged on the external wall of the discharge vessel. The external wall serves in this case, inter alia, as a dielectric layer which separates the electrodes from the discharge during operation of the lamp. This type of discharge is therefore also termed a bilaterally dielectrically impeded discharge.

The spectrum of the electromagnetic radiation emitted by such as lamp can, in this case, comprise both the visible region and the UV (ultraviolet)/VUV(vacuum ultraviolet) region and the IR (infrared) region. Furthermore, a fluorescent layer can also be provided for converting invisible radiation into visible radiation.

Furthermore, the invention relates to a discharge lamp having a tubular discharge vessel sealed at both ends. The cross section of the discharge vessel is preferably circular. However, even only approximately circular cross sections, for example regular polygons such as, for example, hexagons, etc are also suitable. The term "tubular" is not restricted here to straight tubular discharge vessels, but likewise comprises bent, for example angled, tubular discharge vessels. Since the discharge direction runs essentially perpendicular to the lamp longitudinal axis, the length of the lamp is also not limited in principle.

Such lamps are used, in particular, in equipment for office automation (OA), for example color copiers and color scanners, for signal lighting, for example as brake lights and direction indicator lights in automobiles, for auxiliary lighting, for example interior illumination of automobiles, and for background lighting of displays, for example liquid crystal displays, and so-called "edge-type backlights".

These technical fields require both particularly short start-up phases, and luminous fluxes which are as independent as possible of temperature. Consequently, these lamps contain no mercury. Rather, these lamps are usually filled with inert gas, preferably xenon, or inert gas mixtures.

The said applications require both a high luminous density and a luminous density which is uniform over the length of the lamp. To increase the luminous density, lamps for OA use are normally provided with an aperture along the longitudinal axis. Increasing the power injected into previous systems does not suffice to raise the luminous density further, since the loading of a lamp cannot be raised at will for lasting and reliable operation. A further difficulty is, that with the systems used so far in copiers and scanners, the efficiency of the discharge decreases with increasing injected power.

2. Background Information

U.S. Pat. No. 5,117,160 discloses an inert gas discharge lamp for OA equipment. There are two strip-shaped electrodes arranged along the lamp longitudinal axis on the outer surface of the wall of a tubular discharge vessel. The lamp is operated with AC voltage at a preferred frequency of between 20 kHz and 100 kHz. During operation, the 147 nm xenon line is excited. The efficiency of the useful radiation which can be achieved with the employed mode of operation, and consequently the resulting luminous density are relatively low.

It is known, furthermore, from U.S. Pat. No. 5,604,410 that the efficiency of dielectrically impeded discharges can be raised substantially compared with the dielectrically impeded discharges excited with AC voltage (see U.S. Pat. No. 5,117,160) with the aid of a pulsed operation (pulsed, dielectrically impeded discharge) adapted to the particular conditions (striking distance, electrode configuration, electrode geometry, filling gas and filling pressure).

SUMMARY OF THE INVENTION

It is the object of the present invention to eliminate the said disadvantages and provide a discharge lamp, in particular also a fluorescent lamp, with an improved luminous density.

This object is achieved by means of the present invention.

The term "electrode pair" is firstly introduced for the purpose of better comprehension of what follows. It is understood here as two elongated, mutually parallel electrodes having different polarities during operation, between which a "discharge plane" burns during operation. In the case of the preferred pulse-type injection of active power in accordance with U.S. Pat. No. 5,604,410, the discharge plane comprises a flat discharge structure which comprises a multiplicity of individual discharges.

According to the invention, the discharge lamp has three or more elongated electrodes which are arranged on the external wall of the tubular discharge vessel of the lamp and parallel to the longitudinal axis of the tubular discharge vessel in such a way that the following relationship is satisfied:

$$\frac{s}{a} \geq 0.1,$$

preferably $$\frac{s}{a} \geq 0.2$$

and more preferably $$\frac{s}{a}$$

is greater than 0.25 s defining the maximum spacing between the imaginary connecting line of an electrode pair and the most closely neighboring wall of the discharge vessel, and a defining the mutual spacing between the electrodes of this electrode pair (measured centrally starting from the electrodes). Reference is also made in this connection to FIG. 6 which shows diagrammatically on the example of a discharge lamp 1 and three electrodes 3, 4 and 5 the maximum spacing s between the imaginary connecting line 20 of an electrode pair 3, 4 or 3,5 and the most closely neighboring wall of the discharge vessel 2.

Thus, during operation, at least two discharge planes are generated which extend between corresponding electrode pairs and along the longitudinal axis of the discharge vessel. A multiplicity of individual discharges are lined up in this plane next to one another along the electrodes and merge in the limiting case into a type of form of discharge resembling a curtain.

In this case, the discharge planes can also have a common electrode, for example in the case of three electrodes, in which two electrodes of the same polarity have only one common counter electrode of opposite polarity. In other words, in this case two electrode pairs share a common electrode. In the case of unipolar voltage pulses, this is preferably the cathode, the two other electrodes being connected as anodes. Further discharge planes can be generated inside the discharge vessel in order to increase the luminous density of the lamp still further.

In the case of three electrodes, these are preferably—seen in cross section—arranged at least approximately at the corner points of an imaginary isosceles or equilateral triangle. The latter case has the advantage that the lamp can be produced fairly simply, since the lamp need in each case be rotated only by 120° in order to mount the second and third electrodes. Moreover, it may be shown with the aid of simple geometrical considerations that in this case the quotient s/a always assumes the value $1/(2.\sqrt{3})\approx 0.29$, independently of the lamp diameter, and consequently satisfies the relationship described previously. By contrast, the arrangement in the form of an isosceles triangle has the advantage that it is possible thereby to realize larger striking distances (and thus higher injected electric powers, see further below) for the two discharge planes, if the angle formed by the two discharge planes is selected to be less than 120°.

With four electrodes, it is possible either to realize two independent discharge planes, or else three discharge planes with a common electrode, depending on whether in the case of unipolar excitation the four electrodes are connected as two cathodes and two anodes, or as one cathode and three anodes (or one anode and three cathodes).

In principle, it is also possible for more than three discharge planes to be generated in this way. However, it basically depends on the diameter of the discharge tube whether it is possible at all in the case of three and more discharge planes for there still to be an electrode arrangement which satisfies the above described relationship.

A higher efficiency of useful radiation is achieved with the aid of the teaching according to the present invention. This is to be ascribed, inter alia, to the higher electric power injected with the aid of a plurality of discharge planes in simultaneous conjunction with an optimized striking distance of discharges and low wall losses.

To be precise, it has emerged that it is certainly initially possible to inject a higher electric power into the lamp by means of more than two electrodes. However, the efficiency with which the useful radiation is generated can decrease again with an increasing number of electrodes. According to the present state of knowledge, this is blamed, inter alia, on increasing wall losses when, to be specific, the discharges which are generated by an electrode pair run too close to the inner wall of the discharge vessel, or there is even a surface creeping discharge. It is also advantageous to aim for as large a striking distance as possible, because the starting or operating voltage rises thereby, with the result that a higher electric power can be injected. For this reason, the number of electrodes and their polarity and positioning are to be selected as a function of the diameter of the discharge vessel such that the above described relationship is satisfied. In principle, when there is an even number of electrodes it is suitable to operate both with unipolar and with bipolar voltage pulses for injecting active power in accordance with U.S. Pat. No. 5,604,410. In the case of an odd number of electrodes, operation with unipolar voltage pulses is preferred.

It has also emerged that the electrode arrangement according to the invention permits a relatively high filling pressure of the active discharge gas, typically 150 torrs (approximately 20 kPa) and more, without the formation of discharge instabilities, for example discharge arcs, which detract from efficient generation of useful radiation. The higher filling pressure of the active discharge gas—which is to be understood as the gas component which generates the radiation—likewise contributes to a higher efficiency of useful radiation. An inert gas, in particular xenon, or an inert gas mixture, for example xenon and krypton, is suitable as active gas filling inside the discharge vessel. In addition, it is also possible to add to the active discharge gas a buffer gas which does not participate directly in the generation of radiation, for example neon. Excimers, for example $Xe_2^*$-excimers, are generated in the discharge as particles emitting electromagnetic radiation.

Each external wall electrode is constructed as an electrically conductive, elongated, preferably "line-like" strip—which can, however, also have a substructure—and is orientated parallel to the longitudinal axis of the tubular discharge vessel. The width of a strip is typically approximately 1 mm and less. On the one hand, in this way the shading by three or more electrodes is kept low, even in the case of lamps of small diameter. On the other hand, it has emerged that a higher efficiency is thereby achieved for the generation of useful radiation.

Moreover, at least part of the inner wall can have a fluorescent layer. In addition, one or more reflective layers for visible light made, for example, of $Al_2O_3$ and/or $TiO_2$, can be applied below the fluorescent layer. If appropriate, a portion of the light emitted by the fluorescent layer is thus prevented from being transmitted through the vessel wall. Rather, the light is essentially directed onto the aperture by reflection or multiple reflection, and the luminous density is consequently increased there. As an alternative, the fluorescent layer can also itself be co-used additionally as a reflective layer by applying the fluorescent layer with an adequate thickness. In both cases, only a strip-shaped aperture remains uncoated or is coated only with a relatively thin fluorescent layer. As a result, the aperture has an increased luminous density during operation.

It can be advantageous for reasons of shock protection to sheath the lamp with a transparent electric insulation, for example, with a transparent plastic shrink-fit sleeving, protective varnish or the like.

BRIEF DESCRIPTION OF THE DRAWINGS

The invention is explained in more detail below with the aid of a plurality of exemplary embodiments. In the drawings.

DETAILED DESCRIPTION OF THE INVENTION

Figure 1:
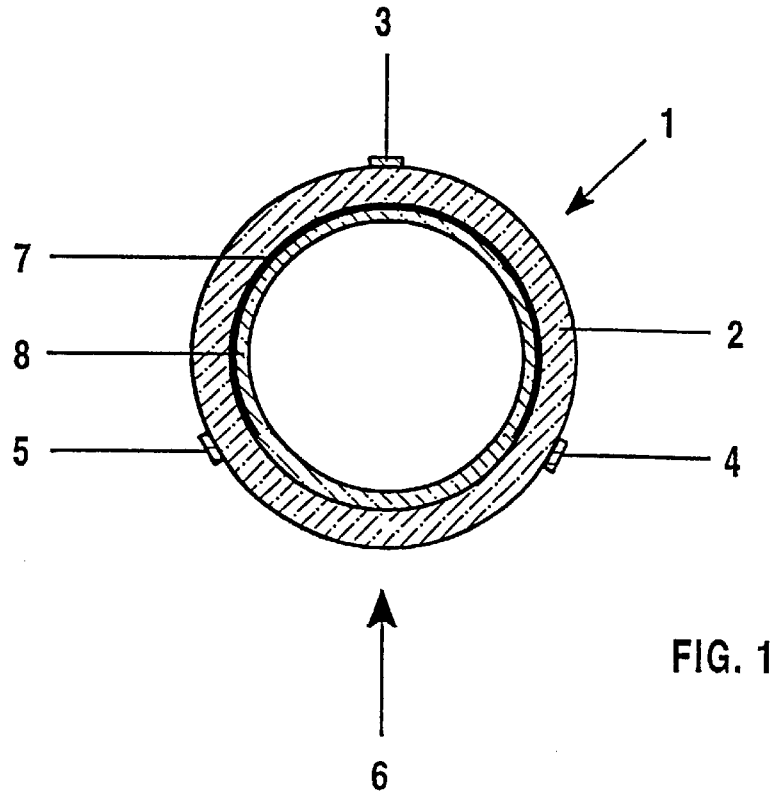
FIG. 1 shows a cross section through a fluorescent lamp according to the present invention, having an aperture and having three external wall electrodes.

FIG. 1 shows a cross section of an aperture fluorescent lamp 1 for OA applications in a very diagrammatic representation. In this case, the thicknesses of the wall, the reflective layer and the fluorescent material as well as the width of the electrode strips are all, in particular, depicted greatly enlarged for reasons of representation. The lamp 1 essentially comprises a tubular discharge vessel 2 with a circular cross section, and a first, a second and a third strip-shaped electrode 3, 4 and 5. Excepting a rectangular aperture 6, the inner wall of the discharge vessel 2 has a reflective layer 7. A fluorescent layer 8 is applied to this reflective layer 7 and to the inner wall in the region of the aperture 6. The discharge vessel 2 is sealed in a gas-tight fashion (not represented) at two ends in the shape of a dome. Xenon at a filling pressure of 160 torrs (approximately 21.33 kPa) is located inside the discharge vessel 2.

The three electrodes 3, 4 and 5 are constructed as metal foil strips. The first electrode is provided as a cathode 3, the two others as anodes 4 and 5 (unipolar operation). Seen in cross section, the electrodes 3, 4 and 5 are arranged at the corner points of an imaginary isosceles triangle on the external wall of the discharge vessel 2. Consequently, during pulsed operation in accordance with U.S. Pat. No. 5,604,410 two planes are formed which have dielectrically impeded individual discharges (not represented). A first discharge plane extends inside the discharge vessel 2 between the cathode strip 3 and the first anode strip 4. The other discharge plane extends correspondingly between the cathode strip 3 and the second anode strip 5.

The respective width of the anode strips 4, 5 is 0.9 mm. The width of the cathode strip 3 is 0.8 mm. The outside diameter of the tubular discharge vessel 2 made of glass is approximately 9 mm in conjunction with a wall thickness of approximately 0.5 mm. The width and the length of the aperture 6 are approximately 6.5 mm and 255 mm, respectively. The fluorescent layer 7 is a three-band fluorescent material. It comprises a mixture of the blue component $BaMgAl_{10}O_{17}$:Eu, the green component $LaPO_4$:Ce,Tb and the red component $(Y,Gd)BO_3$:Eu. The resulting color coordinates are x=0.395 and y=0.383, that is to say white light is generated.

Figure 2:
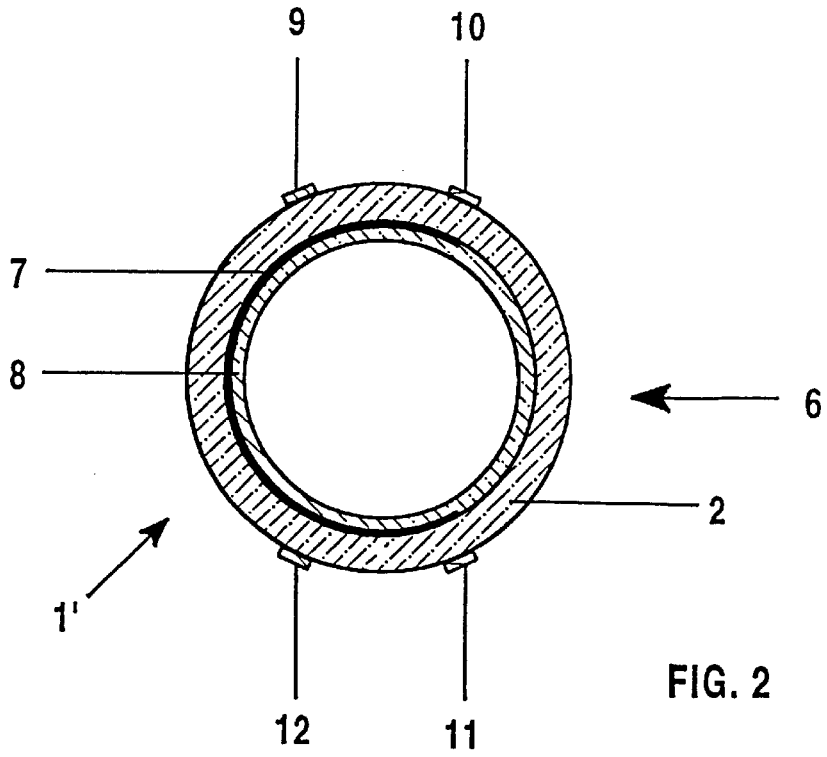
FIG. 2 shows a cross section through a fluorescent lamp according to the present invention, having an aperture and having four external wall electrodes.

The lamp in FIG. 2—similar features being designated by the same reference numerals as in FIG. 1—has four external wall electrodes 9, 10, 11 and 12. Of these, two electrodes are provided as cathodes 9, 10 and the remaining two electrodes are provided as anodes 11, 12. The two electrode pairs 9, 12 and 10, 11, respectively, are arranged in such a way on the external wall that the two discharge planes (not represented) burning during operation between one electrode pair in each case are orientated parallel to one another. It is true that the somewhat lesser striking distance by comparison with FIG. 1 is disadvantageous. However, this electrically symmetrical arrangement is well-suited for bipolar operation. The aperture 6 is arranged centrally between an electrode pair in such a way that over wide regions of the aperture 6, the surface normal is orientated in a quasi-perpendicular fashion relative to the two discharge planes.

The lamp of FIG. 2 is provided for automobile illumination, specifically as a brake light or direction indicator light, for example, depending on the fluorescent material used in each case.

Figure 3:
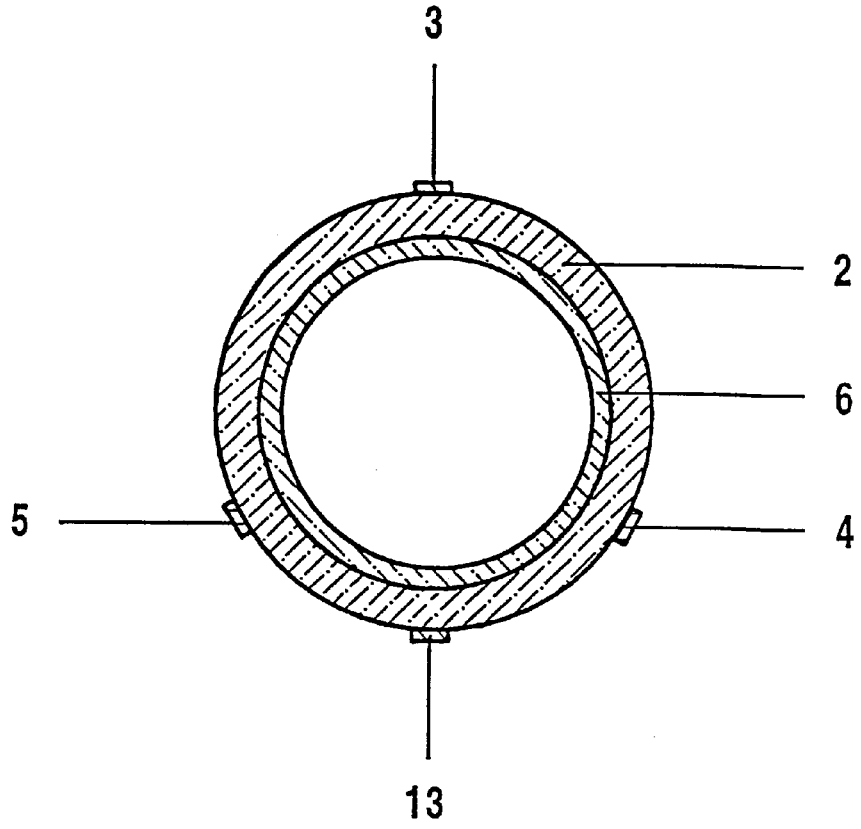
FIG. 3 is similar to FIG. 2 but has an altered arrangement of the electrodes and the distribution of polarity.

The lamp in FIG. 3 differs from that in FIG. 1 by a further electrode 13, which is arranged between the two anodes and is likewise provided as an anode. In the preferably unipolar pulsed operation, a total of three discharge planes are therefore formed, specifically in each case between the first cathode 3 and one each of the three anodes 4, 13 and 5. The internal wall of the discharge vessel 2 has a fluorescent layer 6. A reflective layer and an aperture are dispensed with here.

Figure 4:
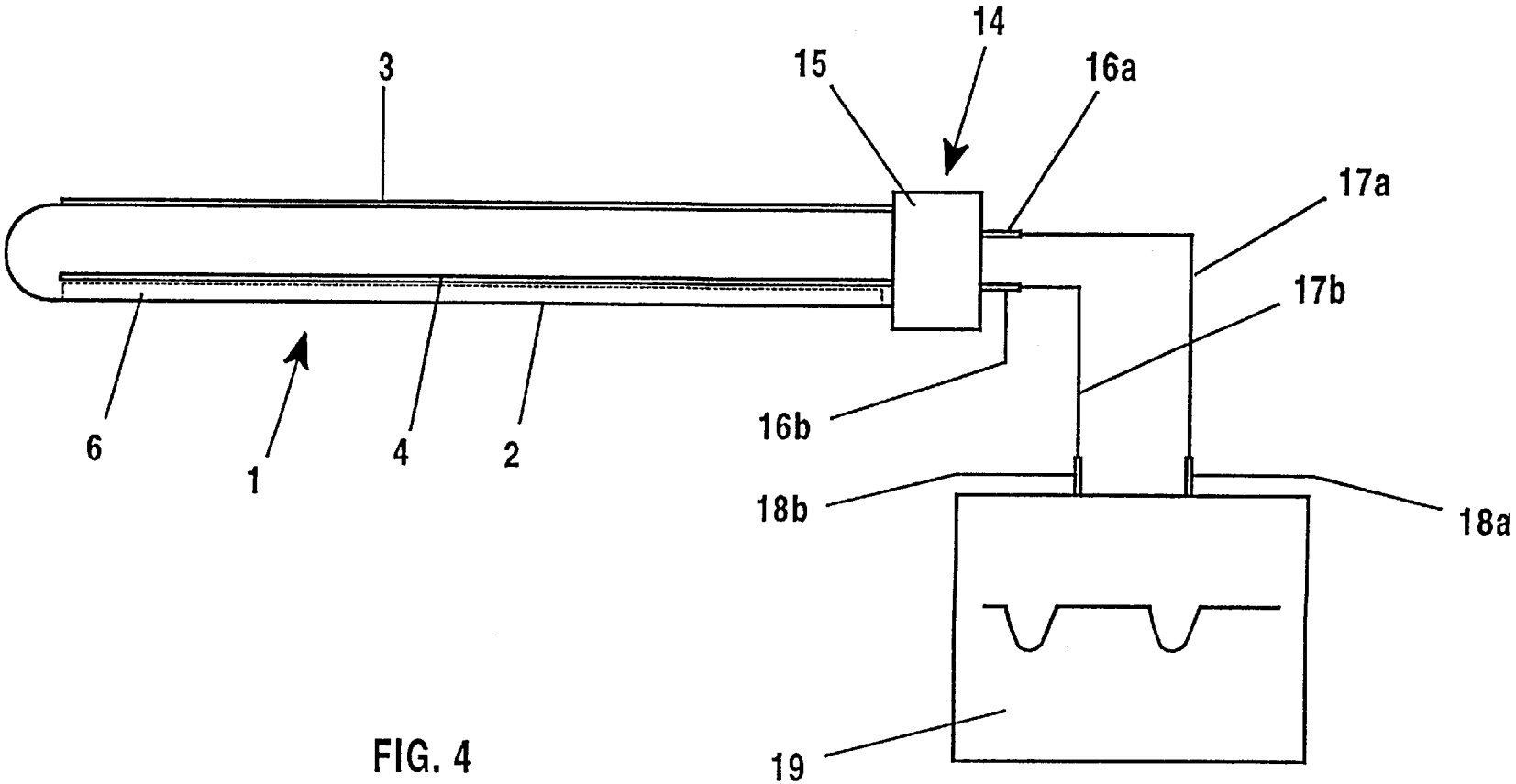
FIG. 4 is a schematic diagram which shows an illuminating system having the aperture fluorescent lamp of FIG. 1 and a pulsed voltage source.

FIG. 4 shows an illuminating system for OA devices. The aperture fluorescent lamp 1 of FIG. 1 additionally has a cap 14 at its second end. The cap 14 essentially comprises a cap part 15 and two connecting pins 16*a*, 16*b*. The cap part 15 serves primarily to hold the lamp 1. Moreover, in the interior of the cap part 15 the external wall cathode 3 and the anodes 4 and 5 (which are covered by the discharge vessel 2 and are therefore not to be seen) are connected (not represented) to the two connecting pins 16*a* and 16*b*, respectively. The connecting pins 16*a*, 16*b* are connected for their part by electric lines 17*a*, 17*b* to the two poles 18*a* and 18*b*, respectively, of a pulsed voltage source 19.

The pulsed voltage source 19 delivers a sequence of unipolar voltage pulses with pulse levels of approximately 3 kV and with a repetition frequency of 80 kHz. The pulse duration is respectively approximately 1.1 $\mu$s. In the case of a lamp length of 300 mm, up to approximately 20 W of electric power can be efficiently injected. When a pure green fluorescent material ($LaPO_4$:Ce,Tb) is used, a luminous density of approximately 45000 cd/m$^2$ is achieved in conjunction with a power consumption of 10 W.

Since a discharge dielectrically impeded at both ends is involved here, it is not only operation with unipolar voltage pulses which is possible, but also likewise operation with bipolar voltage pulses.

Figure 5:
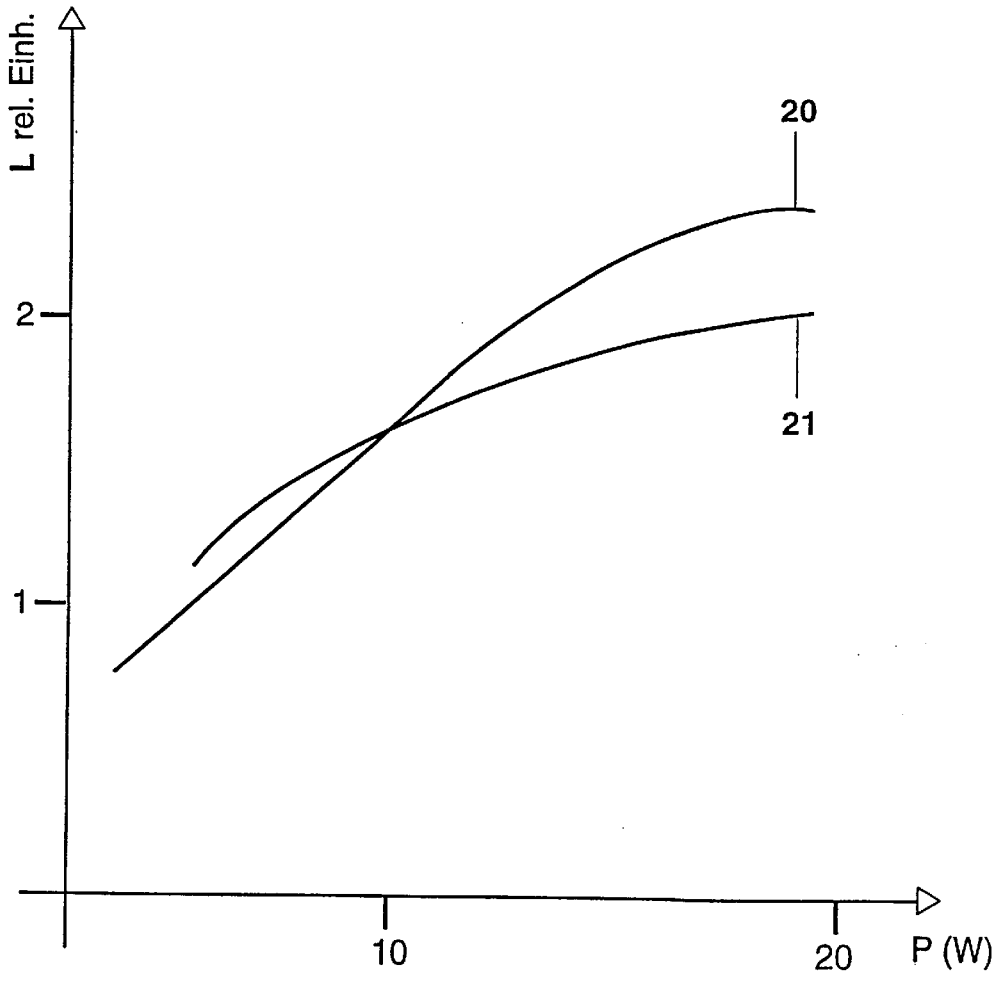
FIG. 5 is a graph which shows a qualitative comparison of two measuring curves of the lamp from FIG. 1, having a lamp with only two external wall electrodes.
Figure 6:
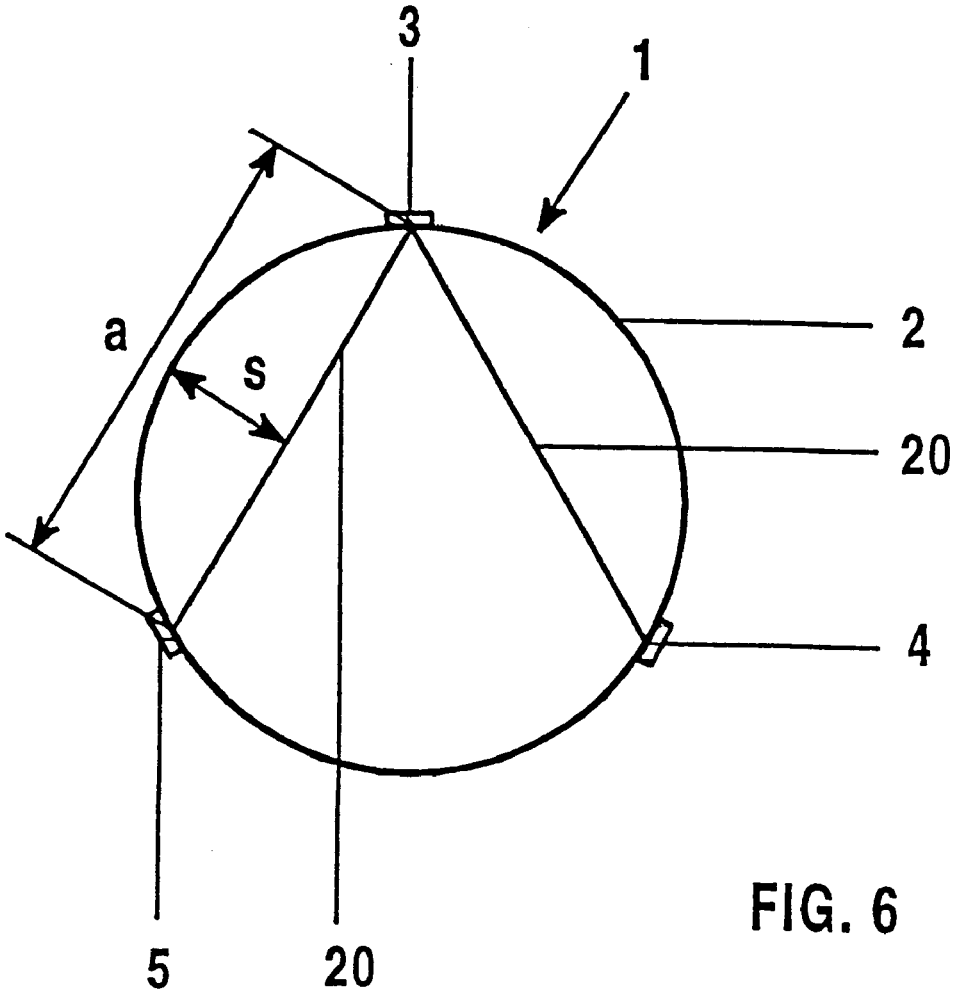
FIG. 6 is a schematic diagram for explaining the maximum spacing s between the imaginary connecting line of an electrode pair and the most closely neighboring wall of the discharge vessel.

In FIG. 5, the luminous density L [cd/m$^2$] measured through the aperture is represented in W in arbitrary units as a function of the time-averaged electric power P. The curve 20 relates to an illuminating system in accordance with FIG. 4 having the operating parameters specified there and three external wall electrodes. The curve 21 relates to a comparable lamp having only two electrodes. It may be gathered in qualitative terms from the figure that the lamp according to the present invention and having three electrodes achieves in the case of electric powers of more than 10 W a substantially higher luminous density than the conventional lamp. Moreover, the curve 20 also still rises in the case of an electric power of 20 W, whereas the curve 21 already flattens out slightly, that is to say exhibits a saturation response.

The present invention is not limited to the exemplary embodiments specified. In particular, it also includes combinations of features of different exemplary embodiments.

What is claimed is:

1. A discharge lamp (1) comprising an at least partially transparent, closed tubular discharge vessel (2) having an external wall, said tubular discharge vessel being filled with a gas filling, and three or more elongated electrodes (3–5, 9–12, 13) which are arranged parallel to the longitudinal axis of the tubular discharge vessel (2) and on the external wall of said tubular discharge vessel (2), wherein the following relationship is satisfied:

$$\frac{s}{a} \geq 0.1$$

wherein s is the maximum spacing between an imaginary connecting line (20) of a pair of electrodes (3, 4; 3, 5) and the most closely neighboring point of said external wall of the tubular discharge vessel (2), and a is the mutual spacing between the electrodes of said pair of electrodes.

2. The discharge lamp according to claim 1, wherein $$\frac{s}{a} \geq 0.2.$$

3. The discharge lamp according to claim 1, wherein the number of the electrodes of one polarity (3) differs from the number of the electrodes of the other polarity (4, 5, 13).

4. The discharge lamp according to claim 3, wherein the number of electrodes is three.

5. The discharge lamp according to claim 4, wherein the electrodes (3–5) are arranged, when seen in cross section, at least approximately at the corner points of an imaginary equilateral triangle.

6. The discharge lamp according to claim 4, wherein the electrodes are arranged, when seen in cross section, at least approximately at the corner points of an imaginary isosceles triangle.

7. The discharge lamp according to claim 1, wherein the lamp is a fluorescent lamp and the gas filling comprises an inert gas or an inert gas mixture.

8. The discharge lamp according to claim 7, wherein the gas filling is at a pressure of more than 13 kPa.

9. The discharge lamp according to claim 7, wherein the gas filling contains xenon.

10. The discharge lamp according to claim 1, wherein the width of the electrodes is 1 mm or less.

11. The discharge lamp according to claim 1, wherein the tubular discharge vessel (2) has on at least part of said external wall a layer of fluorescent material or a mixture of fluorescent materials (8).

12. A discharge lamp according to claim 11, wherein the discharge lamp is a fluorescent lamp and the external wall of the tubular discharge vessel (2) is covered by the reflective layer (7), except for an aperture (6) therethrough.

13. A discharge lamp according to claim 1, wherein the discharge lamp is a fluorescent lamp and the tubular discharge vessel (2) has a circular cross section with an inside diameter of less than 20 mm.

14. An illuminating system comprising a discharge lamp according to claim 1 which is a fluorescent lamp (1) and an electric pulsed voltage source (19) which delivers active-power pulses separated from one another by pauses during operation, the electric pulsed voltage source (19) being connected in an electrically conducting fashion to two external supply leads **(17*a*, 17*b*) of the fluorescent lamp (1)**.

15. The illuminating system according to claim 14, wherein the system is characterized by the following operation parameters:

a repetition frequency of the active-power pulses greater than or equal to 20 kHz, and a pulse duration of the active-power pulses of less than 2 $\mu$s.

16. The discharge lamp according to claim 1, wherein $$\frac{s}{a}$$

is greater than 0.25.

17. The discharge lamp according to claim 3, wherein the number of the electrodes of one polarity differs from the number of the electrodes of the other polarity.

18. The discharge lamp according to claim 8, wherein the gas filling contains xenon.

19. The discharge lamp according to claim 13, wherein the tubular discharge vessel has an inside diameter of less than 15 mm.

20. The discharge lamp according to claim 1, wherein the tubular discharge vessel (2) has on at least part of said external wall a layer of fluorescent material or a mixture of fluorescent materials (8) and a reflective layer (7).

* * * * *